US007093546B2

(12) United States Patent
Hardy

(10) Patent No.: US 7,093,546 B2
(45) **Date of Patent: *Aug. 22, 2006**

(54) PRODUCT MANAGEMENT DISPLAY SYSTEM

(75) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/216,493

(22) Filed: Aug. 31, 2005

(65) Prior Publication Data

US 2005/0286700 A1 Dec. 29, 2005

Related U.S. Application Data

(63) Continuation of application No. 10/474,490, filed on Oct. 8, 2003, now Pat. No. 6,964,235, and a continuation of application No. PCT/US02/15760, filed on May 17, 2002.

(60) Provisional application No. 60/291,732, filed on May 17, 2001.

(51) Int. Cl.
*A47B 57/00* (2006.01)

(52) U.S. Cl. ..... 108/60; 108/61; 211/184

(58) Field of Classification Search ..... 108/60, 108/61; 211/184, 183, 59.3, 43, 11
See application file for complete search history.

(56) References Cited

U.S. PATENT DOCUMENTS 4,300,693 A * 11/1981 Spamer ..... 211/59.3
4,685,574 A * 8/1987 Young et al. ..... 211/59.2
4,907,707 A * 3/1990 Crum ..... 211/59.3
5,111,942 A * 5/1992 Bernardin ..... 211/59.3
5,190,186 A * 3/1993 Yablans et al. ..... 221/124
5,341,945 A * 8/1994 Gibson ..... 211/184
5,366,099 A * 11/1994 Schmid ..... 211/59.3
5,464,105 A * 11/1995 Mandeltort ..... 211/184
5,469,976 A * 11/1995 Burchell ..... 211/59.3
5,542,552 A * 8/1996 Yablans et al. ..... 211/59.3
5,562,217 A * 10/1996 Salveson et al. ..... 211/59.3
5,685,664 A * 11/1997 Parham et al. ..... 211/59.3
5,746,328 A * 5/1998 Beeler et al. ..... 211/59.3
6,142,317 A * 11/2000 Merl ..... 211/59.3
6,227,385 B1 * 5/2001 Nickerson ..... 211/59.3
6,964,235 B1 * 11/2005 Hardy ..... 108/61

* cited by examiner

*Primary Examiner*—Jose V. Chen
(74) *Attorney, Agent, or Firm*—Banner & Witcoff, Ltd.

(57) ABSTRACT

An integrated "T" assembly combines into a single integrated assembly, a track portion along both sides of a divider. The T assembly may have a wide-base portion, which may include a spring-urged-pusher track, on one side of the divider and a narrow-base portion on the opposite side of the divider. An offset pusher may have an upper portion that is offset, via an angled offset portion, from a lower portion of the pusher. Additional supporting bases, any of which may include spring-urged-pusher tracks and/or a spring-urged pusher, may be used under a wide product. Left and right side finisher components may be paired with T assemblies near the sides of a merchandise-display shelf. The T assembly, base, and/or end finishers may be coupled to a front rail via a complimentary tongue and groove arrangement and/or a non-slidable engagement, such as mating teeth.

31 Claims, 12 Drawing Sheets

PRODUCT MANAGEMENT DISPLAY SYSTEM

CROSS REFERENCE TO RELATED APPLICATIONS

This application claims priority to U.S. Provisional Application Ser. No. 60/291,732, filed May 17, 2001, PCT Application Ser. No. PCT/US02/15760, filed May 17, 2002, and U.S. application Ser. No. 10/474,490 filed Oct. 8, 2003, now U.S. Pat. No. 6,964,235.

FIELD OF THE INVENTION

The invention relates to a system for displaying, pushing, and dividing merchandise on merchandise-display shelves.

BACKGROUND OF THE INVENTION

It is desirable to have merchandise on a shelf situated toward the front of the shelf so that the merchandise is visible and accessible to shoppers. Thus, as merchandise is removed from a shelf, it may be advantageous to push the remaining merchandise toward the front of the shelf. It may also be desirable to include dividing panels, also referred to as dividers, to separate merchandise into rows on a display shelf.

Commonly assigned U.S. Pat. No. 6,041,720 ("the '720 patent") discloses a product management display system that may be used for dividing and pushing displayed merchandise.

DE 299-02,688 U1 discloses a merchandise display system in which a base-and-divider assembly is constructed as two separate units that need to be connected to each other before being used. When this system is used with products having different sizes, product slider guides, also referred to herein as pusher tracks, of various widths need to be used to accommodate the different sizes of the products.

U.S. Pat. No. 5,265,738 discloses a merchandise display system with a pusher track that has an integrated divider wall on one side of the pusher track. Like the system disclosed by DE 299-02,688 U1, pusher tracks having different widths must be used to accommodate products of different sizes.

Referring to FIG. 1 of the '720 patent, various components, such as pusher end device 150, pusher divider 152, and pusher 154 mounted on bases 166, 212, and 232, respectively, are disclosed for mounting onto either shelf frame 25 or standard dealer shelf 40. The pusher end device 150, the pusher divider 152, and the pusher 154, which are mounted to bases 166, 212, and 232, of FIG. 1 of the '720 patent were designed with ultimate flexibility in mind. This flexibility allows these components to be assembled and used in many different ways depending on the particular product to be displayed. This presents store personnel with potentially confusing choices, which may lead to frustration, wasted time, and incorrectly installed parts. Three pusher components, namely, a full-width track, which can accept the pushing device, a divider, and a narrow track, are typically used together more often than other combinations of components. Therefore, a component that combines these devices into a single integrated assembly would be desirable.

SUMMARY OF THE INVENTION

An integrated "T" assembly, also referred to as a base-and-divider assembly, in accordance with an illustrative embodiment of the invention combines into a single integrated assembly, a full-width track, a divider, and a narrow track. A narrow and strong end-finisher piece may be used to provide a second divider-like partition and, optionally a wide or narrow track, for pairing with a T assembly's narrow-track or wide-track portion near an end of either side of a shelf.

In accordance with an illustrative embodiment of the invention, a spring-urged offset pusher may have an upper portion that is offset, via an angled offset portion, from a lower portion of the pusher. The upper offset portion may advantageously extend farther out toward the center of various products to be displayed. Such an offset pusher may allow for using a minimal number of components while still pushing products relatively near to their centers, having the advantage of pushing them smoothly with less binding. When displaying a wide product, one or more supporting tracks, any of which may have a pusher, may be used under the product.

In accordance with an illustrative embodiment of the invention, a T assembly and/or a full track may be coupled to a front rail via a complimentary tongue and groove arrangement. Any of the components having a divider panel, such as a T assembly, an end finisher, and a full-width track, may also contain any of various engagement mechanisms for non-slidably engaging with a front rail's corresponding engagement mechanism. For instance, teeth on a base may engage corresponding teeth on the front rail. Teeth of this type advantageously allow a T assembly, full-width track, and/or end finishers with corresponding teeth to be located at positions virtually continuously along the front rail and may prevent the components from being moved unintentionally from their intended positions during normal shopping activity and shelf re-stocking.

In accordance with an illustrative embodiment of the invention, a T assembly may include a tear-off line and a break-off line. Such a tear-off line and break-off line combination may be used to advantage to produce one part that may be used for shelves having different depths, such as either 16 inches or 10 inches.

In accordance with an illustrative embodiment of the invention, a pusher track may include a depression, which may be used while re-stocking merchandise to hold a pusher near the back of a full-width track or T assembly. To use the depression to hold a pusher at the back of the track, a person may move the pusher back to the depression and may tilt the top of the pusher toward the front of the track. Merchandise may be re-stocked without having to manually hold the pusher out of the way. To remove the pusher from the depression, the pusher may be pushed toward the back of the track, the pusher will then return to an upright position and move along the track in its usual way.

In accordance with an illustrative embodiment of the invention, front edges of the respective surfaces that the pusher travels along may automatically engage a bent portion of the pusher's coiled spring when the pusher is inserted onto the front of the track.

Additional features and advantages of the invention will be apparent upon reviewing the following detailed description.

DETAILED DESCRIPTION OF THE INVENTION

Figure 1:
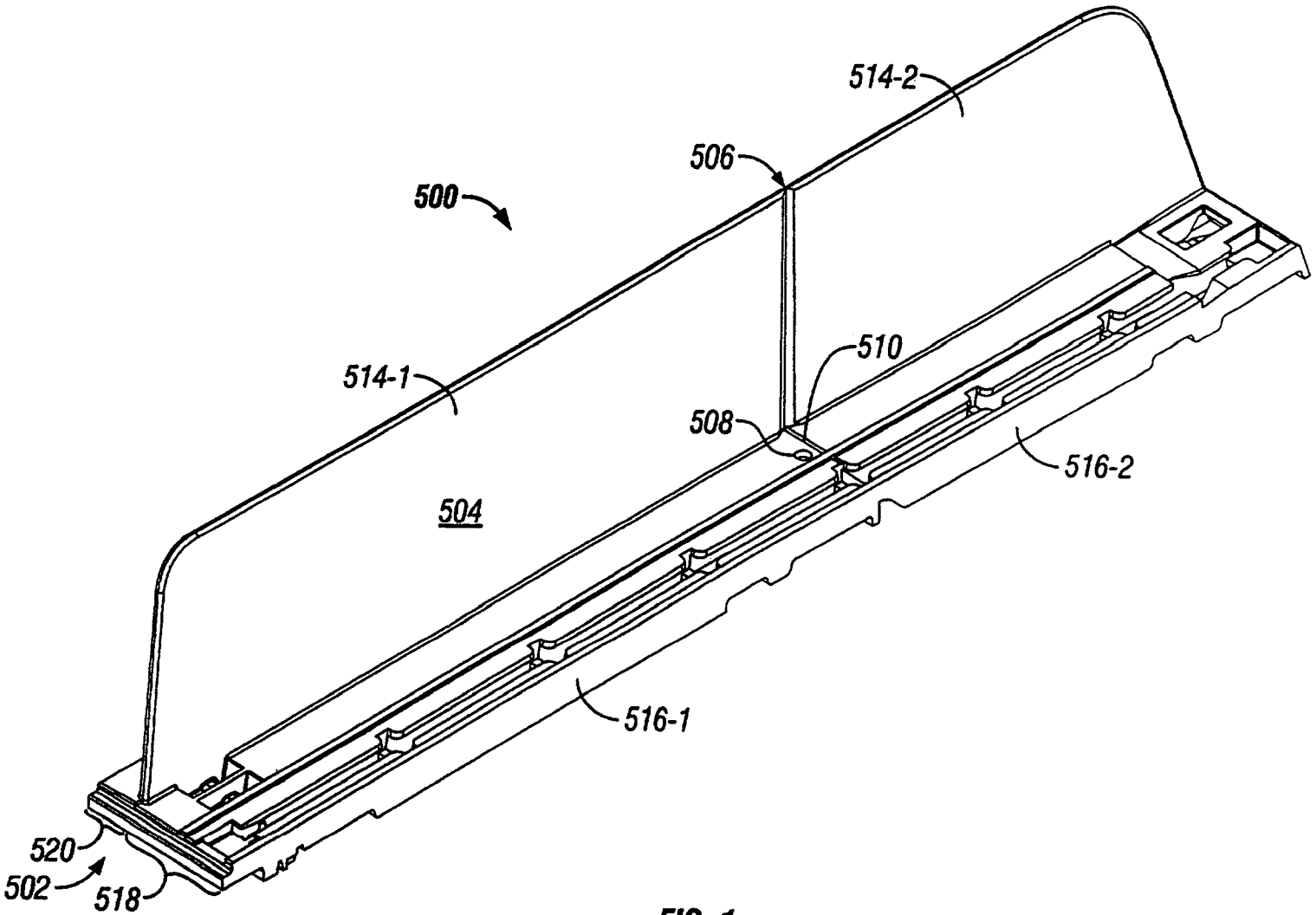
FIG. 1 depicts an integrated "T" assembly, also referred to as a base-and-divider assembly, in accordance with an illustrative embodiment of the invention.
Figure 5:
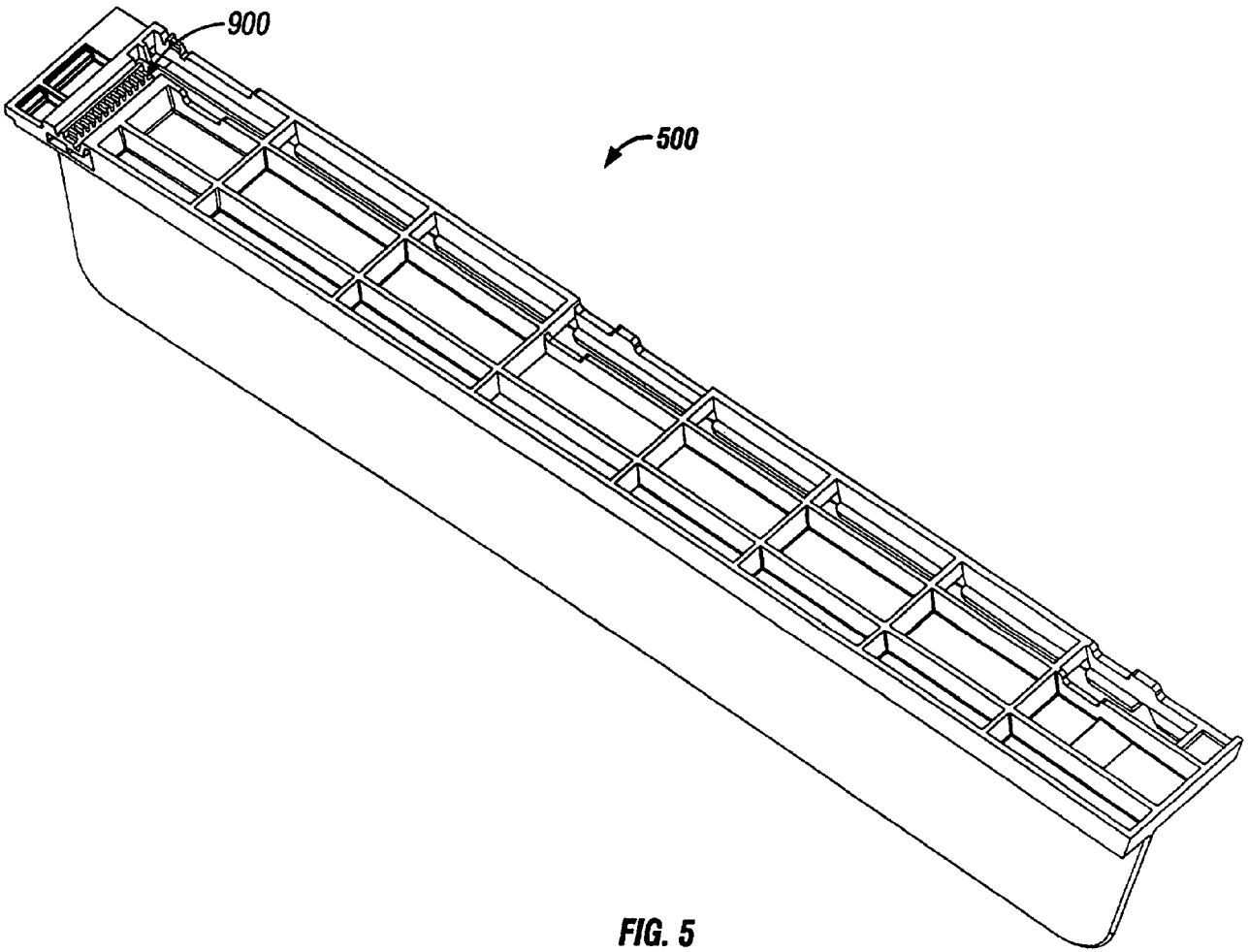
FIG. 5 is perspective view of the bottom of a T assembly in accordance with an illustrative embodiment of the invention.

FIG. 1 depicts an integrated "T" assembly 500 in accordance with an illustrative embodiment of the invention. The "T" refers to the appearance of the T assembly 500 as viewed in the direction of arrow 502 in FIG. 5. T assembly 500 would actually look like an upside-down (and off-center) T, but for the sake of brevity, it is referred to simply as a T assembly. The T assembly may also be referred to as a base-and-divider assembly.

The T assembly essentially combines into a single assembly, a first track, a divider, and a second track. In accordance with an illustrative embodiment of the invention, the divider portion 504, the first portion 518 of the base, and the second portion of the base 520 may be manufactured as a single integrated component.

In accordance with an illustrative embodiment of the invention shown in FIG. 1, a divider 504 may divide the base of the T assembly 500 into a first portion 518 and a second portion 520. The first portion 518 of the base may be referred to as a wide portion of the base and the second portion 520 may be referred to as a narrow portion 520 of the base 500. As will be apparent any suitable ratio of widths may be chosen for the first and second portions of the base. For instance, the divider 504 may bisect the base such that the base's first and second portions are of a substantially equal width.

T assembly 500 may have a relatively thick and rigid divider 504 to prevent deflection that might occur when pushing round or triangular objects. Deflection of this type could cause those objects to slip by one another or not to push well in general. In FIG. 1, rigid divider 504 includes two parts, 514-1 and 514-2, which are described below.

Figure 2:
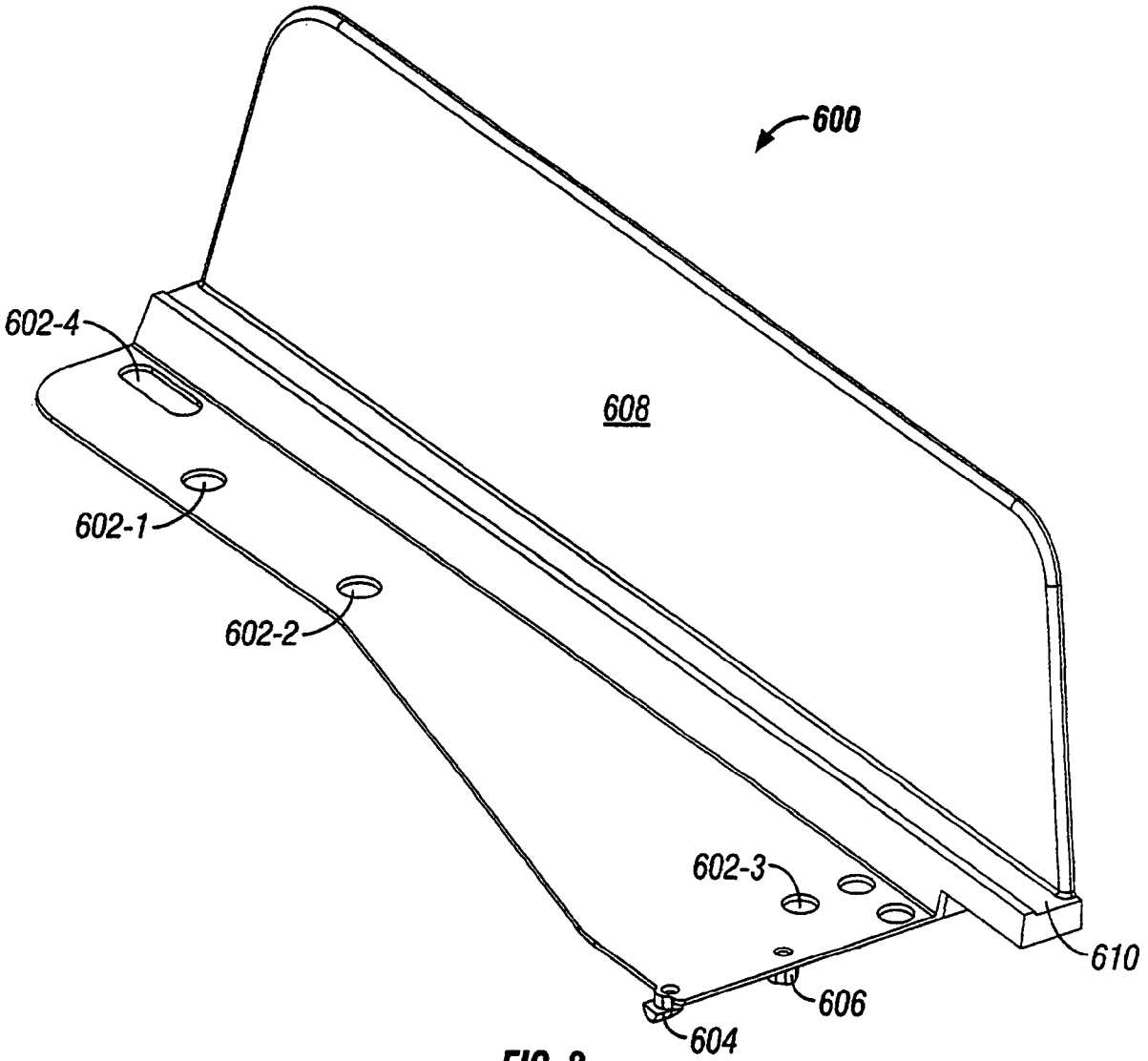
FIG. 2 depicts a right end component in accordance with an illustrative embodiment of the invention.

At either end of a shelf using the pusher components, a narrow and strong end-finisher component is desirable. Referring to FIG. 2, a right-end component 600 may be fastened to a shelf near the right-hand side of the shelf. The right-end component's divider 608 may act the right-most divider on the shelf. The right-end component 600 may be operatively coupled to a shelf by inserting pegs 604 and 606 through corresponding holes in a shelf. One or more fasteners, such as plastic push-rivets, may be used through holes 602-1 through 602-4, and corresponding holes in a shelf, to securely fasten the right-end component to the shelf.

Figure 11:
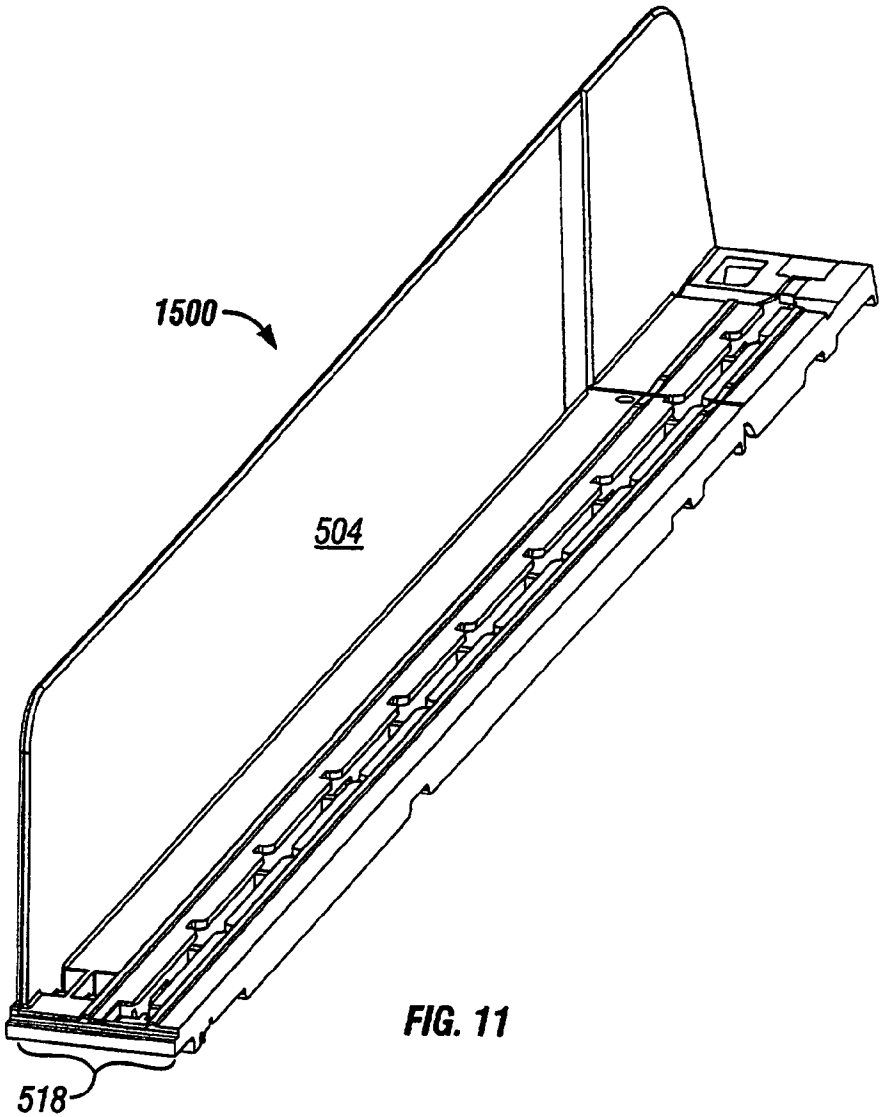
FIG. 11 depicts an integrated end component in accordance with an illustrative embodiment of the invention.

The right-end component shown in FIG. 2 is intended to be placed at a fixed location near the right side of a shelf's top surface. Referring to FIG. 11, a left-end component 1500 may be similar to a T assembly 500 except that, for the left-end component 1500 the portion of the T assembly's base to the left of the divider is omitted. Accordingly, the left-end component 15 may include a divider 504 and a base portion 518. Because the right-end component is intended to have a fixed location and the other components may have adjustable positions along a rail near the front of a shelf, components may be placed onto the shelf and the front rail from right to left to allow for maximum flexibility in adjusting the distances between the components.

Figure 3:
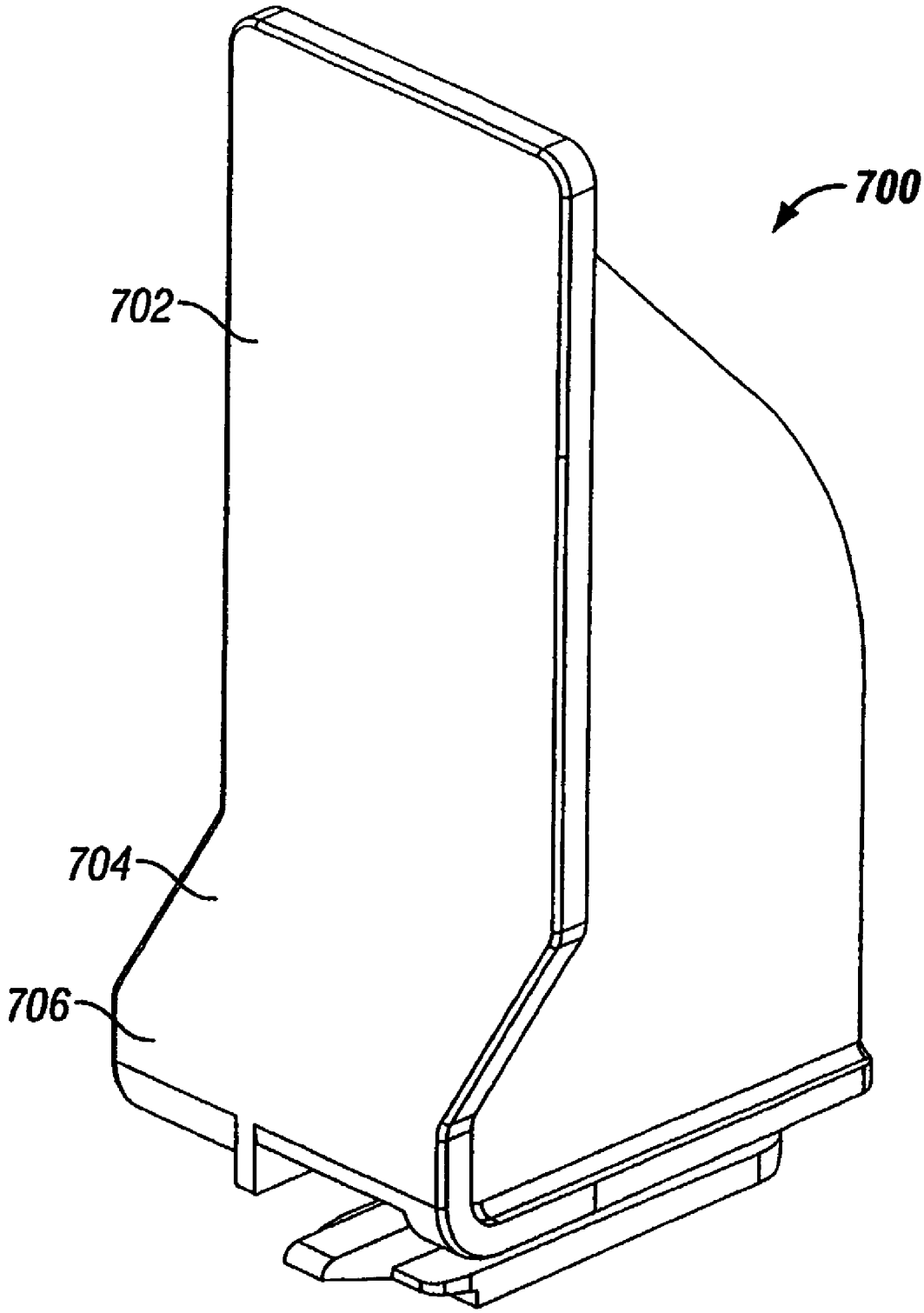
FIG. 3 shows an offset pusher in accordance with an illustrative embodiment of the invention.
Figure 10:
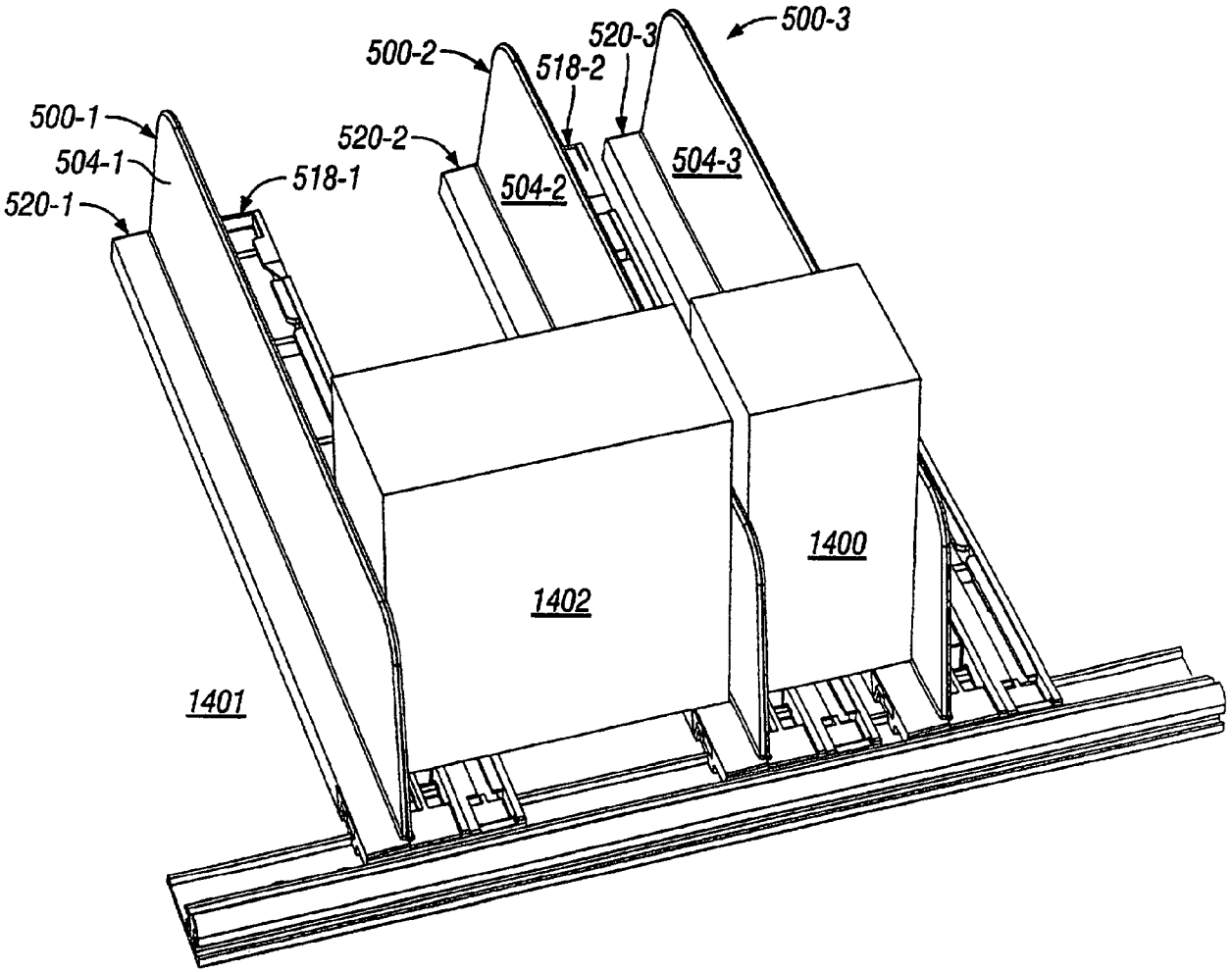
FIG. 10 depicts products of different sizes on multiple T assemblies.

The width of many products, such as deodorants, analgesics, antihistamines, would allow a minimum number of pusher and base components to be used, spaced laterally apart from each other along a shelf, but the pushers may undesirably end up sufficiently off-center such that the products do not get pushed well. For instance, referring to FIG. 10, multiple T assemblies 500-1 through 500-3 are shown operatively coupled to a shelf 1401 via a front rail. A relatively narrow product 1400 is shown being supported by the wide portion 518-2 of the base of T assembly 500-2 and by the narrow portion 520-3 of the T assembly 500-3. T assemblies 500-2 and 500-3 are positioned relatively close to each other because product 1400 is relatively narrow. Product 1402, however, is relatively wide. T assembly 500-1, therefore, is spaced relatively far away from T assembly 500-2. The product 1402 is supported by the narrow portion 520-2 of the base of the T assembly 500-2 and the wide portion 518-1 of the base of the T assembly 500-1. Because the pusher track and pusher of the T assembly 500-1 are located relatively close to the divider 504-1 of T assembly 500-1, an offset pusher, such as the offset pusher 700 (FIG. 3) may be used so that the offset portion 702 may be positioned closer to the center of a relatively wide product, such as product 1402. Offset pusher 700 has an upper portion 702 that is offset, via an offset portion 704, from a lower portion 706 of the pusher 700. Upper offset portion 702 advantageously extends farther out toward the center of various products to be displayed. The offset pusher allows for using a minimal number of components while still pushing products relatively near to their centers.

Occasionally a product is too wide to use only T assemblies 500 on either side of the product. Under these circumstances, one or more supporting tracks may be used under the product. In addition, a product may be unusually dense and/or heavy such that the product requires another track with an additional pusher to move the product. Under these circumstances, a full-width track, such as full-width track 800, shown in FIG. 4 and also referred to as a base, may be used either with or without a pusher 700.

Figure 8:
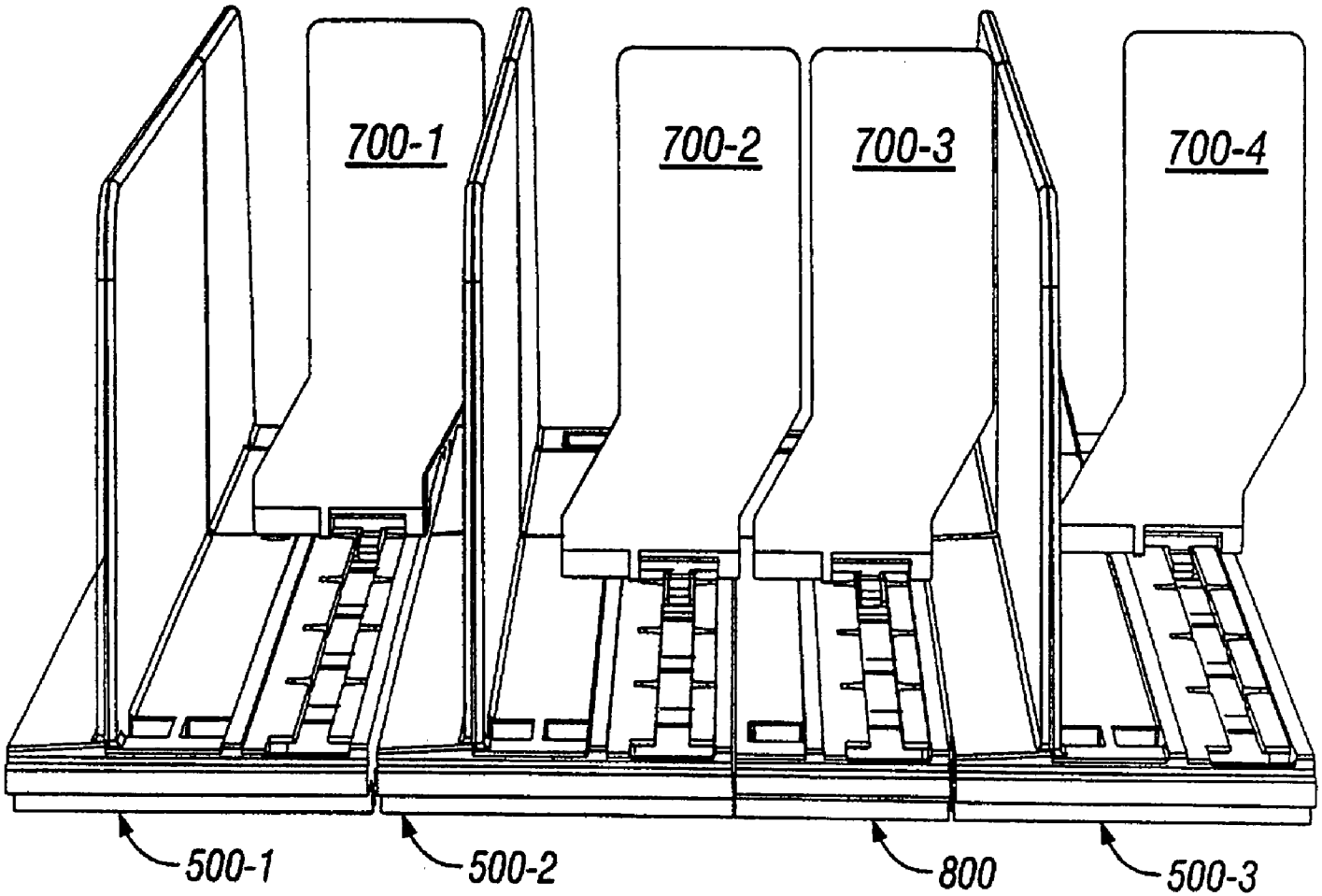
FIG. 8 depicts a full-width track with a pusher between two T assemblies in accordance with an illustrative embodiment of the invention.

For instance, FIG. 8 depicts a full-width track 800 with a pusher 700-3 between two T assemblies 500-2 and 500-3 with pushers 700-2 and 700-4 to the left and right sides, respectively, of the full-width track 800.

Figure 6:
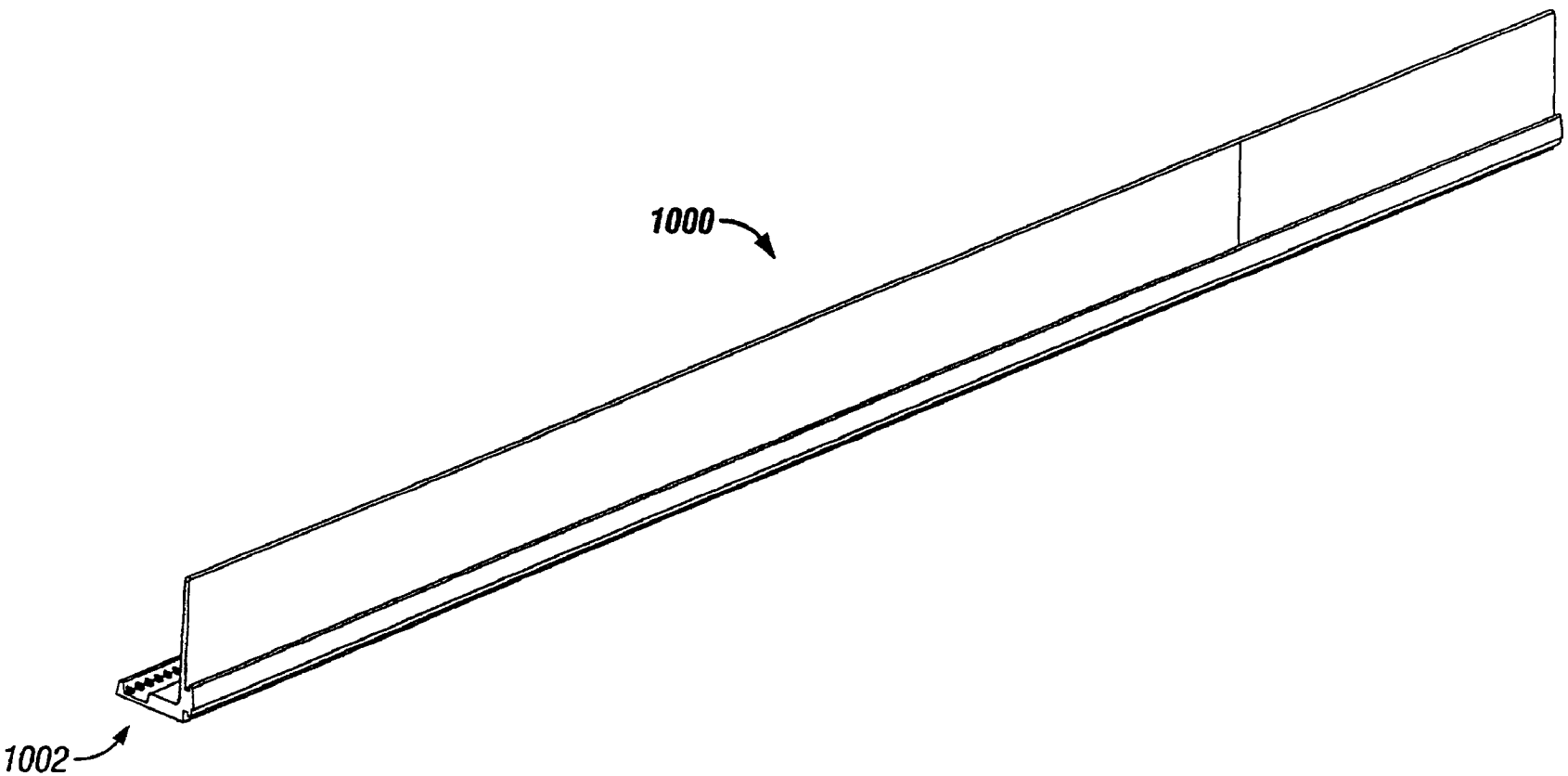
FIG. 6 is a perspective view of a front rail in accordance with an illustrative embodiment of the invention.
Figure 7:
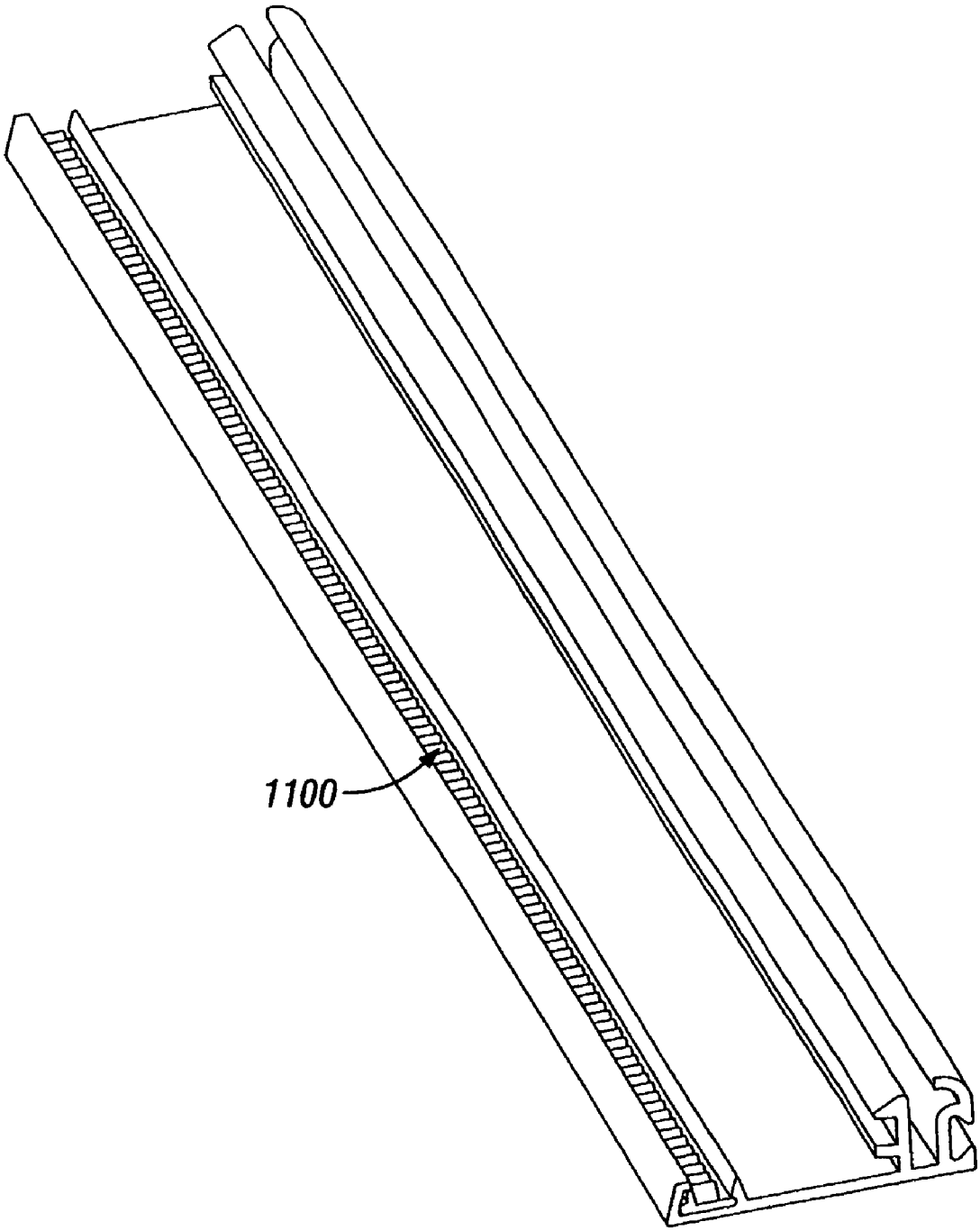
FIG. 7 is an enlarged oblique side view of the front rail of FIG. 7 in accordance with an illustrative embodiment of the invention.

In accordance with an illustrative embodiment of the invention, any of the components, which have a divider and/or a pusher track, may be coupled to a front rail via a complimentary tongue and groove arrangement as disclosed in the '720 patent. The T assembly 500 and full track 800 may non-slidably engage each other. For instance, teeth 900, shown in FIG. 5, may engage a corresponding non-slidable engagement detail in a front rail, such as front rail 1000 shown in FIG. 6. FIG. 7 is an enlarged oblique side view of the front rail 1000, viewed from the direction indicated by arrow 1002 in FIG. 6. Teeth 1100 allow a T assembly 500, full-width track 800, and/or a left-end component with corresponding teeth to be located at virtually continuous positions along the front rail. The mating teeth may be relatively thin and closely spaced to allow for precise placement of pusher-track components. The teeth advantageously prevent the components from being unintentionally moved from their intended positions during normal shopping activity and shelf re-stocking.

As will be apparent, other ways of positively engaging T assembly 500, full-width track 800, and/or a left-end component with the front rail may also be used. For instance, serrations on the front rail could bite into the bottom of the pusher-track components. A compression fit arrangement could be used in which a tongue of the pusher-track component snaps into the front rail. The front rail could have rubber in a groove that would receive a serrated tongue of a pusher-track component.

Referring again to FIG. 1, the T assembly 500 may optionally include a tear-off line, such as tear-off line 506, and a break-off line, such as break-off line 510. Such a tear-off line and break-off line combination may be used to advantage to produce one part that may be used for shelves having different depths, such as either 16 inches or 10 inches. Tear-off line 506 allows tearing of the vertically oriented divider pieces 514-1 and 514-2 as a first operation. This tearing operation may then be followed by a breaking operation to separate track piece 516-1 from track piece 516-2. The combination of the tear-off line and the break-off line facilitates removal of the rear portion of the T assembly 500. As will be apparent, a full-width track and/or a right-end finisher may also optionally include a break-off line analogous to the break-off line 510.

Figure 9:
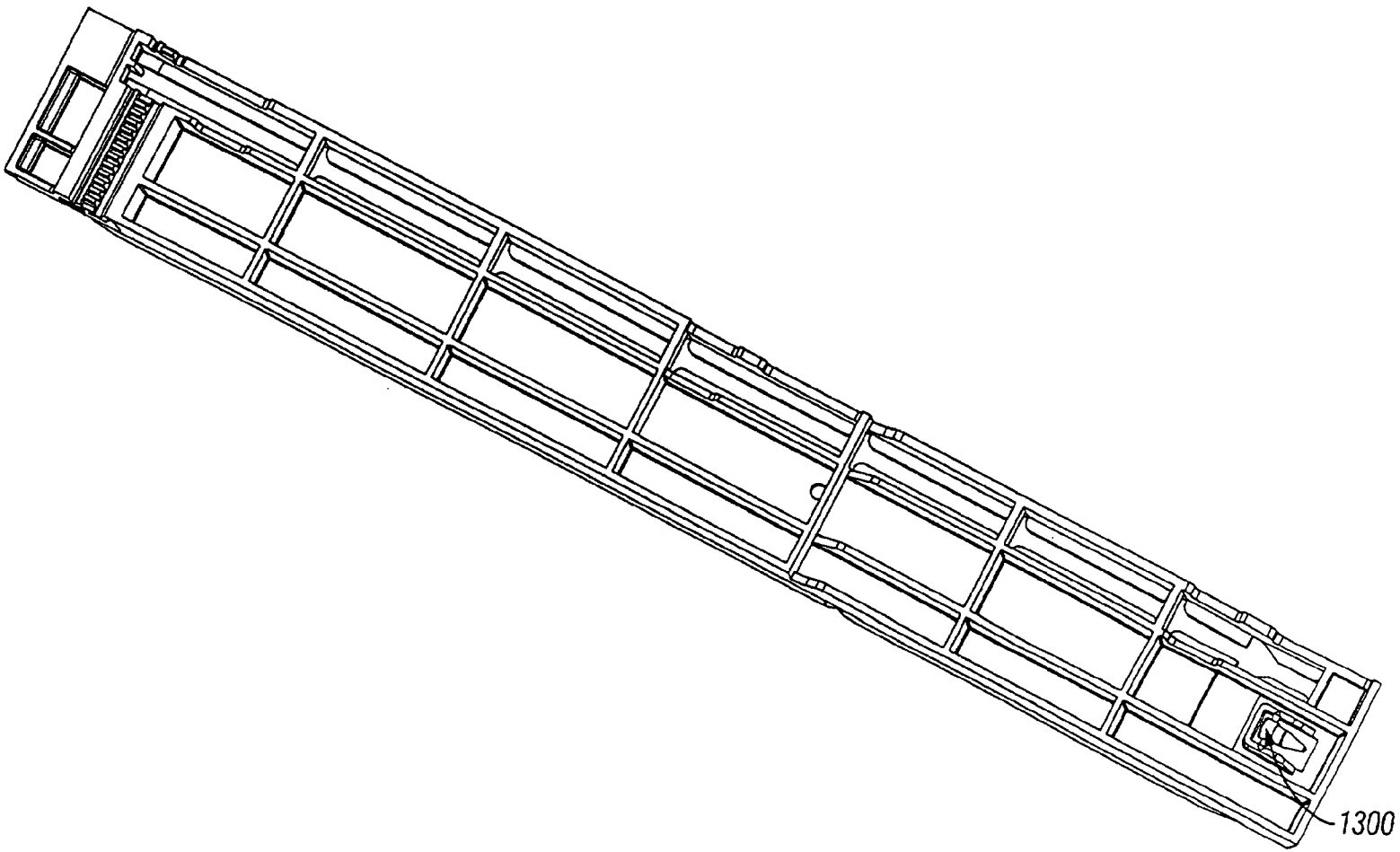
FIG. 9 is an enlarged view of the rear portion of the bottom of a T assembly in accordance with an illustrative embodiment of the invention.

After removing the rear portion of the T assembly 500 or any other base that may accept a pusher 700, the pusher 700 may be prevented from sliding out of the back of the pusher track by inserting a pin into hole 508. An exemplary pin 1300 is shown molded into the bottom rear portion of a base in FIG. 9.

Figure 4:
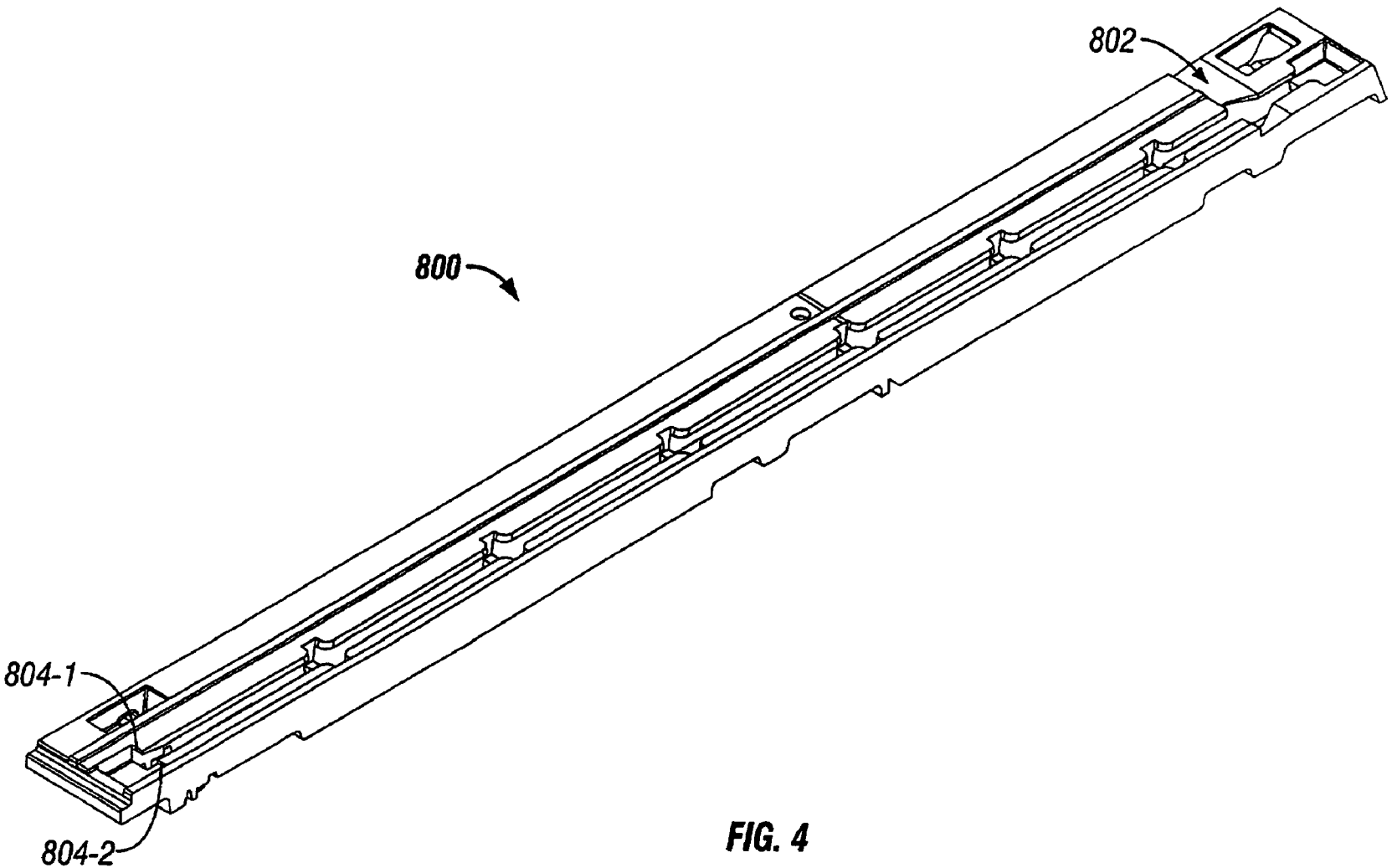
FIG. 4 shows a full-width track, also referred to as a base, which may be used with or without a pusher, in accordance with an illustrative embodiment of the invention.

Referring to FIG. 4, a depression 802 is shown. The depression 802 may be used, while re-stocking merchandise, to hold a pusher 700 near the back of a track 800 or a T assembly 500. To use the depression 802 to hold a pusher 700 at the back of the track 800, a person may move the pusher 700 back to the depression 802 and may tilt the top of the pusher 700 toward the front of the track 800, for instance, in a direction opposite of arrow 502 in FIG. 1. The depression 802 then holds the pusher 700 SO that merchandise may be re-stocked without having to manually hold the pusher out of the way while placing the merchandise on the track surface. To remove the pusher 700 from the depression 802, the pusher may be pushed toward the back of the track 800, the pusher will then return to an upright position and move along the track 800 in its usual way.

Figure 12:
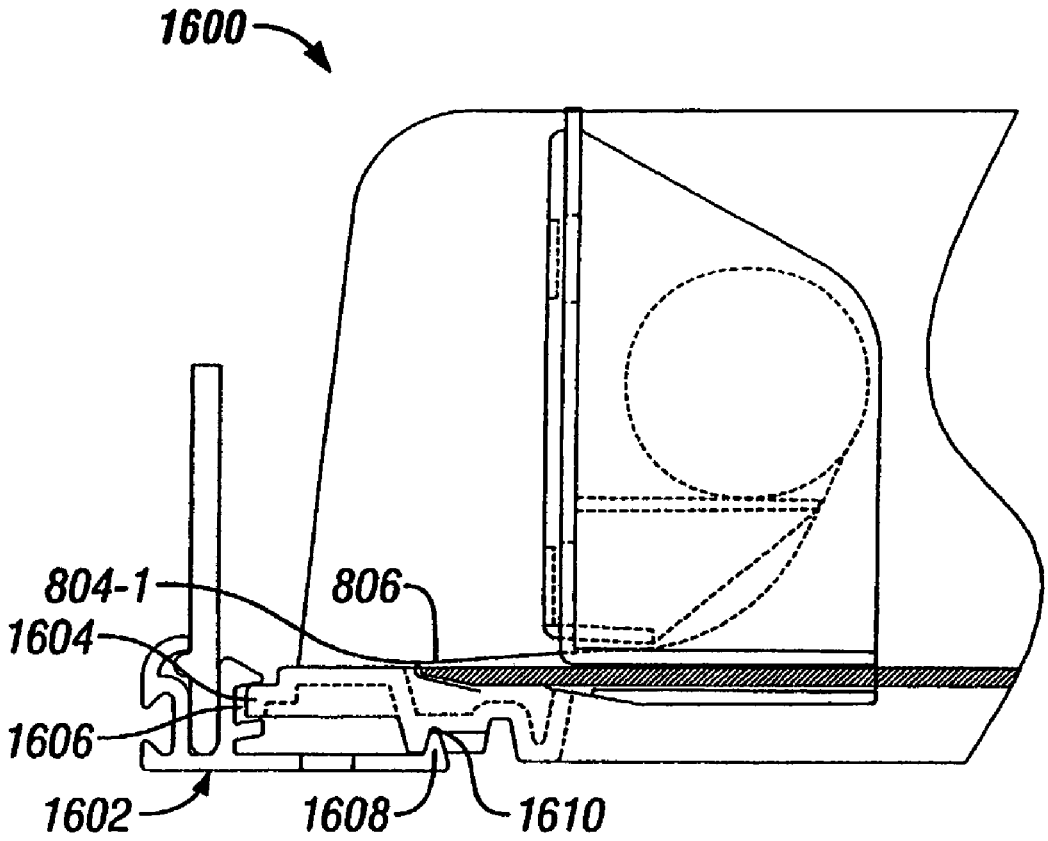
FIG. 12 is a partial side view of a cross-section of a bent end of a pusher's coiled spring engaging the front edge of a pusher track in accordance with an illustrative embodiment of the invention.

Front edges 804-1 and 804-2 of the respective surfaces that the pusher travels along may automatically engage a bent portion of the pusher's coiled spring when the pusher is inserted onto the front of the track 800. FIG. 12 is a partial side view of a cross-section of a bent end of a spring 806 engaging the front edge 804-1 of the track 800.

FIG. 12 also shows a complimentary tongue and groove engagement between a component 1600, which includes a pusher track, and a front rail 1602 in accordance with an illustrative embodiment of the invention. A tongue 1604 of the component 1600 engages a groove 1606 of the front rail 1602, and a tongue 1608 of the front rail 1602 engage a groove 1610 in the component.

While the invention has been described with respect to specific examples including presently preferred modes of carrying out the invention, those skilled in the art will appreciate that there are numerous variations and permutations of the above described systems and techniques that fall within the spirit and scope of the invention.

What is claimed is:

1. A merchandise-display system comprising:

an integrated base-and-divider assembly, wherein the base-and-divider assembly includes a base portion adapted for operative coupling to a front rail, and a divider portion for dividing displayed merchandise into rows, wherein the divider portion protrudes from the base portion such that the divider portion separates the base portion into a first portion and a second portion; and a spring-urged pusher mounted to a pusher track for pushing merchandise toward the front of the shelf, the pusher comprising an off-set pusher face, the pusher track comprising a first rail with a top surface and a bottom surface, a second rail with a top surface and a bottom surface, an elongated aperture between the first rail and the second rail, a plurality of ribs connecting the first rail and the second rail, and wherein the first rail defines a plurality of notches and the second rail defines a plurality of notches, wherein the base-and-divider assembly and pusher track are separate components and each are mounted to a front rail that extends along a front portion of the shelf.

2. The merchandise-display system of claim 1, wherein the pusher track includes a depression for holding the pusher near the back of the track in a shelf-stocking position.

3. The merchandise-display system of claim 1, wherein the offset pusher face has an upper portion that is offset from a lower portion by an angled offset portion.

4. The merchandise-display system of claim 3, further comprising a coiled spring defining a first end coupled to the pusher track and a second coiled end positioned behind the pusher.

5. The merchandise-display system of claim 4, wherein the base-and-divider assembly and the pusher track are slidable relative to the front rail.

6. The merchandise-display system of claim 1, wherein the pusher engages the top and bottom surfaces of the first rail, and the top and bottom surfaces of the second rail.

7. The merchandise-display system of claim 1, wherein the base-and-divider assembly and the pusher track are non-slidable relative to the front rail.

8. The merchandise-display system of claim 1, wherein the base portion supports a first portion of a displayed product.

9. The merchandise-display system of claim 8, further comprising:

a second integrated base-and-divider assembly defining a second base portion. and a second spring-urged pusher having an offset pusher face and adapted for operative coupling to the front rail, wherein the second base portion of the second base-and-divider assembly supports a second portion of the displayed product.

10. The merchandise-display system of claim 1, wherein the base portion is operatively coupled to a shelf via the front rail that is affixed to the shelf.

11. The merchandise-display system of claim 1, wherein the base portion is operatively coupled to the front rail via a tongue and groove arrangement.

12. The merchandise-display system of claim 1, wherein the pusher track is operatively coupled to the front rail via a tongue and groove arrangement.

13. A merchandise-display system comprising:

a unitary, one-piece base and divider assembly comprising a base and a divider, wherein the divider protrudes from the base and separates the base into a first portion and a second portion;

a rail operatively coupled to a shelf, the base end divider assembly mounted to the rail;

a pusher track comprising a first rail and a second rail, an elongated aperture between the first rail and the second rail, a plurality of ribs connecting the first rail and the second rail, and wherein the first rail and second rail define a plurality of notches, the pusher track mounted to the rail;

a spring-urged pusher comprising a bottom engagement device for mounting to the pusher track, the pusher defining a pusher face further defining an upper portion that is off-set from a lower portion by an angled portion; and a coil spring connected to the pusher track, the coil spring urges the pusher forward along the pusher track, wherein the base and divider assembly and pusher track are separate components.

14. The merchandise-display system of claim 13 wherein the pusher track defines a front end and the coil spring defines a front portion and wherein the front end of the coil spring engages the front end of the pusher track.

15. The merchandise-display system of claim 13 wherein the pusher track defines a depression near a rear portion of the pusher track, and wherein the depression is configured to hold the spring-urged pusher near the rear portion of the pusher track during restocking.

16. The merchandise-display system of claim 13 wherein the pusher face further comprises a first edge having a top and bottom portion, and a second edge having a top and bottom portion, wherein the bottom portion of the first edge is nearer to the divider than the top portion of the first edge during operation of the system, and wherein the bottom portion of the second edge is nearer to the divider than the top portion of the second edge during operation of the system.

17. The merchandise-display system of claim 16 further comprising a front barrier designed to deter products from being pushed beyond the front barrier by the spring-urged pusher.

18. The merchandise-display system of claim 13 further comprising an end component mounted to the shelf.

19. The merchandise-display system of claim 13, wherein the base is operatively coupled to the rail via a tongue and groove arrangement.

20. The merchandise-display system of claim 13, wherein the pusher track is operatively coupled to the rail via a tongue and groove arrangement.

21. A product display system comprising:

a pusher assembly mountable to a shelf, the pusher assembly including a pusher and a track, the pusher defining an off-set pusher face, and the track defining an elongated channel with spaced apart notches, and connectors positioned beneath the spaced apart notches; and a T-shaped divider for dividing displayed product into rows, the T-shaped divider including a horizontal portion and a vertical portion, the vertical portion dividing the horizontal portion into a first portion and a second portion, wherein the pusher track and at least one of the first and second portions support merchandised product, and wherein the off-set pusher face defines a first pusher face portion and a second pusher face portion, the first pusher face portion positioned farther away from the divider than the second pusher face portion.

22. The product display system of claim 21 wherein the pusher comprises a bottom engagement device comprising a first flange and a second flange and wherein the first flange contacts the track and the second flange contacts the track during operation of the system.

23. The product display system of claim 22 wherein the off-set pusher face has a first edge and a second edge) the second edge having a top portion and a bottom portion, and wherein the first edge of the face is nearer to the divider than the second edge of the face during operation of the system and wherein the bottom portion of the second edge of the face is nearer to the divider than the top portion of the second edge of the face during operation of the system.

24. The product display system of claim 21, wherein the pusher assembly is operatively coupled to a rail via a tongue and groove arrangement.

25. The product display system of claim 21, wherein the divider is operatively coupled to a rail via a tongue and groove arrangement.

26. The product display system of claim 21 wherein the track defines a depression near a rear portion of the track, and wherein the depression is configured to hold the pusher near the rear portion of the track during restocking.

27. The product display system of claim 21, wherein the pusher assembly is operatively coupled to a rail via a plurality of teeth.

28. The product display system of claim 21, wherein the divider is operatively coupled to a rail via a plurality of teeth.

29. The product display system of claim 21 wherein the track defines a hole for receiving a pin for preventing the pusher from sliding out of the rear portion of the track.

30. The product display system of claim 21 wherein the track defines a breakaway portion for reducing the length of the track, and wherein the divider defines a breakaway portion for reducing the length of the divider.

31. The product display system of claim 21 further comprising at least one end finishing component mounted to the shelf.

* * * * *